United States Patent [19]

Vadas

[11] 4,300,602

[45] Nov. 17, 1981

[54] NO POUCH - NO FILL APPARATUS WITH MEMORY SYSTEM

[75] Inventor: Leslie Vadas, Los Gatos, Calif.

[73] Assignee: FMC Corporation, Chicago, Ill.

[21] Appl. No.: 110,651

[22] Filed: Jan. 24, 1980

[51] Int. Cl.[3] ..... B65B 3/04; B65B 57/06

[52] U.S. Cl. ..... 141/103; 53/67; 141/114; 141/159

[58] Field of Search ..... 53/506, 67, 505; 141/138–143, 156–162, 103, 114

[56] References Cited

U.S. PATENT DOCUMENTS

| | | | |
|---|---|---|---|
| 2,582,381 | 1/1952 | Higginbottom | 53/506 X |
| 2,689,073 | 9/1954 | Twigg | 53/505 |
| 3,427,780 | 2/1969 | Bock | 53/506 |
| 3,589,410 | 6/1971 | Manas | 141/141 |

*Primary Examiner*—Frederick R. Schmidt

*Attorney, Agent, or Firm*—A. J. Moore; R. B. Megley

[57] ABSTRACT

A no pouch - no fill device with a memory system is disclosed for controlling two spaced filling valve systems at sequentially filled products into a pouch when the pouch is at different filling stations in response to the detection of a properly opened pouch by a vacuum detection system located at a pouch opening station upstream of the two filling stations. If no pouch or an improperly positioned pouch is sensed at the opening station, the no pouch - no fill device will prevent actuation of the filling valve system when the absence or improperly positioned pouch eventually enters the filling stations.

17 Claims, 7 Drawing Figures

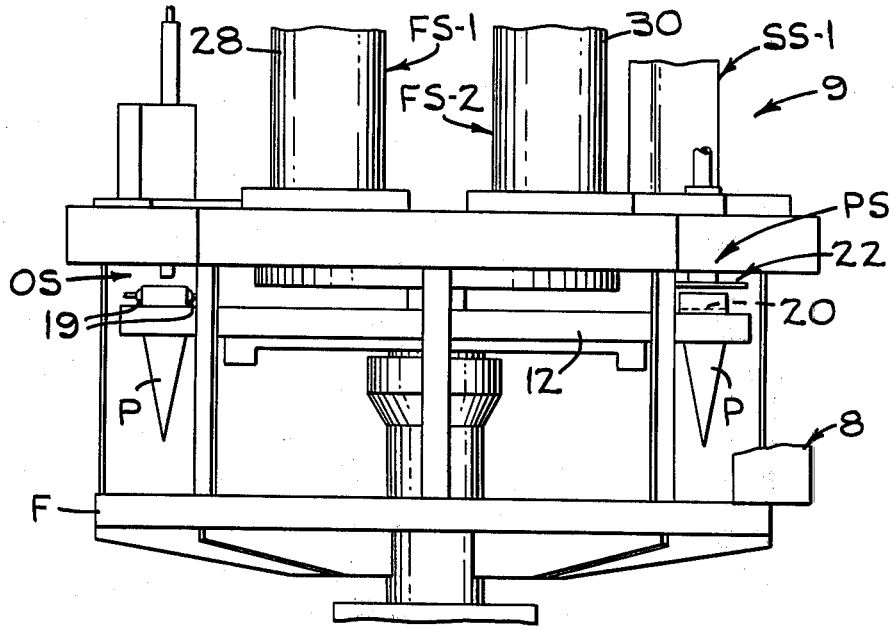
FIG_1
FIG_2
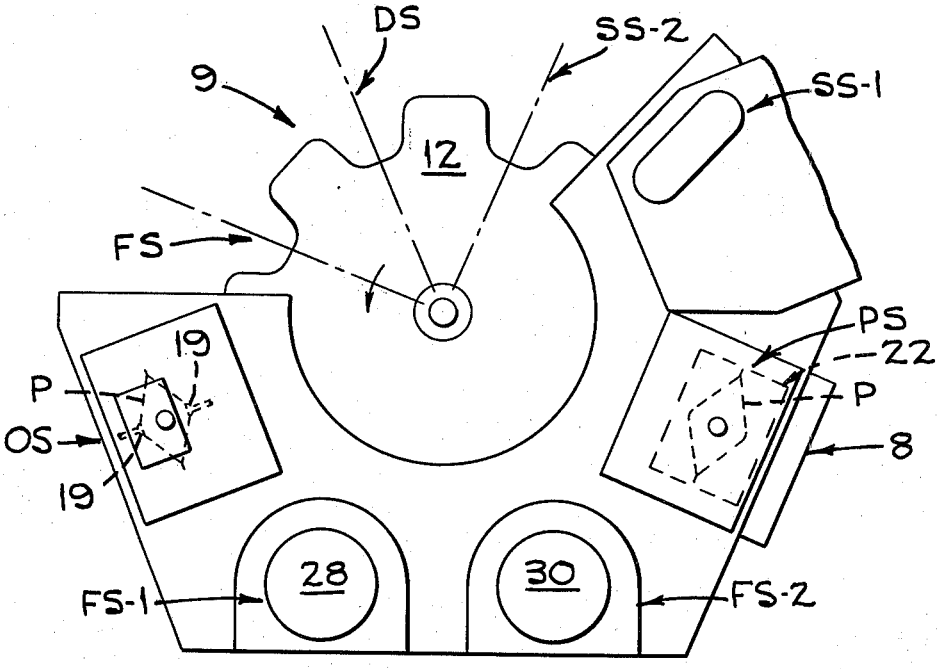

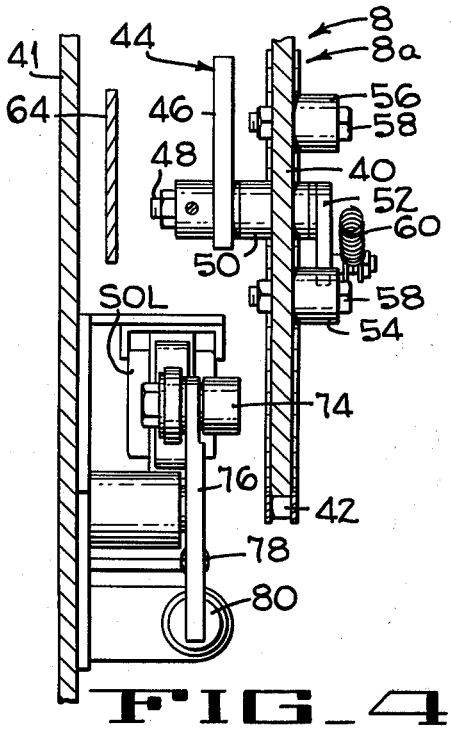
FIG_4
FIG_5
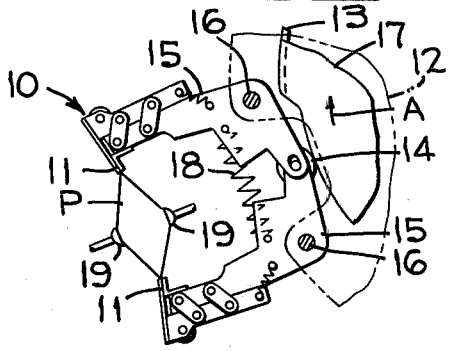
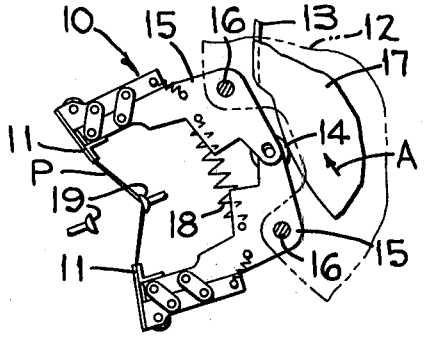
FIG_6
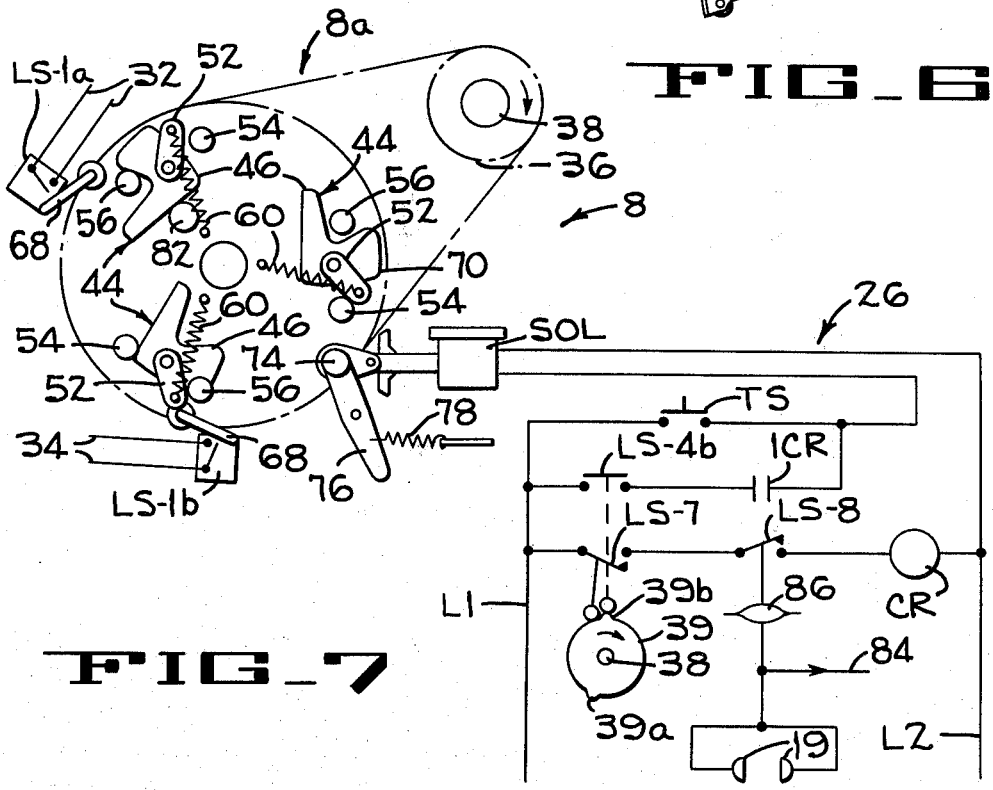
FIG_7

NO POUCH - NO FILL APPARATUS WITH MEMORY SYSTEM

BACKGROUND OF THE INVENTION

1. Field of the Invention

The present invention pertains to pouch filling machines having a plurality of filling systems, and more particularly relates to a no pouch—no fill mechanism which is responsive to a vacuum detection system and to a memory system for the filling machine.

2. Description of the Prior Art

No pouch—no fill mechanisms are well known in the art and prevent a filling system from operating in the event a pouch or bag is not present to receive the product from a single filling head, or a pouch is present but is improperly opened.

U.S. Pat. No. 2,689,073 which issued to Twigg on Sept. 14, 1954 discloses a filler for bags which are opened by suction cups. If one or both of the suction cups do not properly engage the bag, a pressure switch will not be subjected to a sub-atmospheric pressure that is great enough to close the switch thereby preventing discharge of material from the single filler. However, this patent does not disclose the combination of a vacuum detection system and a mechanical memory system which makes it possible to prevent the discharge of material at two different filling stations unless the bag is present and properly opened to receive the material at the two stations.

U.S. Pat. No. 3,427,780 which issued to Bock on Feb. 18, 1969 discloses a pouch opening system using suction cups. If the suction cups are not properly gripping a bag, insufficient vacuum will be present and a switch will remain open thus preventing a discharge of material from a single filling valve in the absence of a properly positioned and opened pouch.

U.S. Pat. No. 3,589,410 which issued to Manas on June 29, 1971 discloses a rotary turret filler having a no container—no fill device which permits the discharge of a product into a container only when a container is present under an associated filling valve and is lifted upwardly into filling position against the valve.

SUMMARY OF THE INVENTION

In accordance with the present invention no pouch—no fill mechanism is defined in combination with a memory system. The combination is provided for controlling two filling systems which direct products into a single pouch that is carried by grippers of a pouch opening and filling machine which uses suction cups to open the pouches. If a vacuum switch detects the presence of sufficient vacuum in the lines to both suction cups indicating that a pouch carried by the grippers is properly opened, this signal will be imparted to a memory system which will affect the operation of the two filling systems to discharge or meter products into the detected open pouch at two spaced filling stations. If the vacuum switch detects that one or both suction cups are open to the atmosphere when they should be closed by being attached to the side walls of the pouch as the pouch approaches its fully open position; a signal from the vacuum switch will set the memory system so that the two filling systems will not be operated sequentially when the empty pouch grippers (or improperly opened pouch) are in the two filling positions.

In accordance with the present invention the combination of a no pouch—no fill mechanism and memory system in a pouch opening and filling machine having two filling systems is provided, said combination comprising pouch supporting means for cyclically moving a pouch from a pouch opening station sequentially into spaced filling stations in positions to receive a product from both filling systems; means for gripping and opening pouches when at said opening station; pouch detecting means associated with said gripping means for detecting the presence of a properly opened pouch, and for detecting the absence of a pouch or the presence of an improperly opened pouch; and memory means responsive to said detecting means for preventing opening of said two filling systems when said pouch supporting means is in said two filling stations and no pouch is present or an improperly opened pouch is sequentially moved into said filling stations.

BRIEF DESCRIPTION OF THE DRAWINGS

FIG. 1 is a diagrammatic side elevation of a turret type pouch opening, filling, purging and sealing machine in which the no pouch—no fill mechanism of the present invention is employed.

FIG. 2 is a diagrammatic plan of the machine of FIG. 1 illustrating the locations of the pouch opening stations and two filling stations which are controlled by the no pouch—no fill mechanism of the present invention.

FIG. 4 is a vertical section taken along lines 4—4 of FIG. 3.

FIG. 5 is a planned view of the pouch grippers at the pouch opening station illustrating a properly opened pouch.

FIG. 6 is a planned view similar to FIG. 5, but showing the grippers with an improperly opened pouch therein.

FIG. 7 is a diagrammatic operational view and circuit diagram illustrating the no pouch—no fill mechanism, and its memory system of the present invention.

DESCRIPTION OF THE PREFERRED EMBODIMENT

Figure 3:
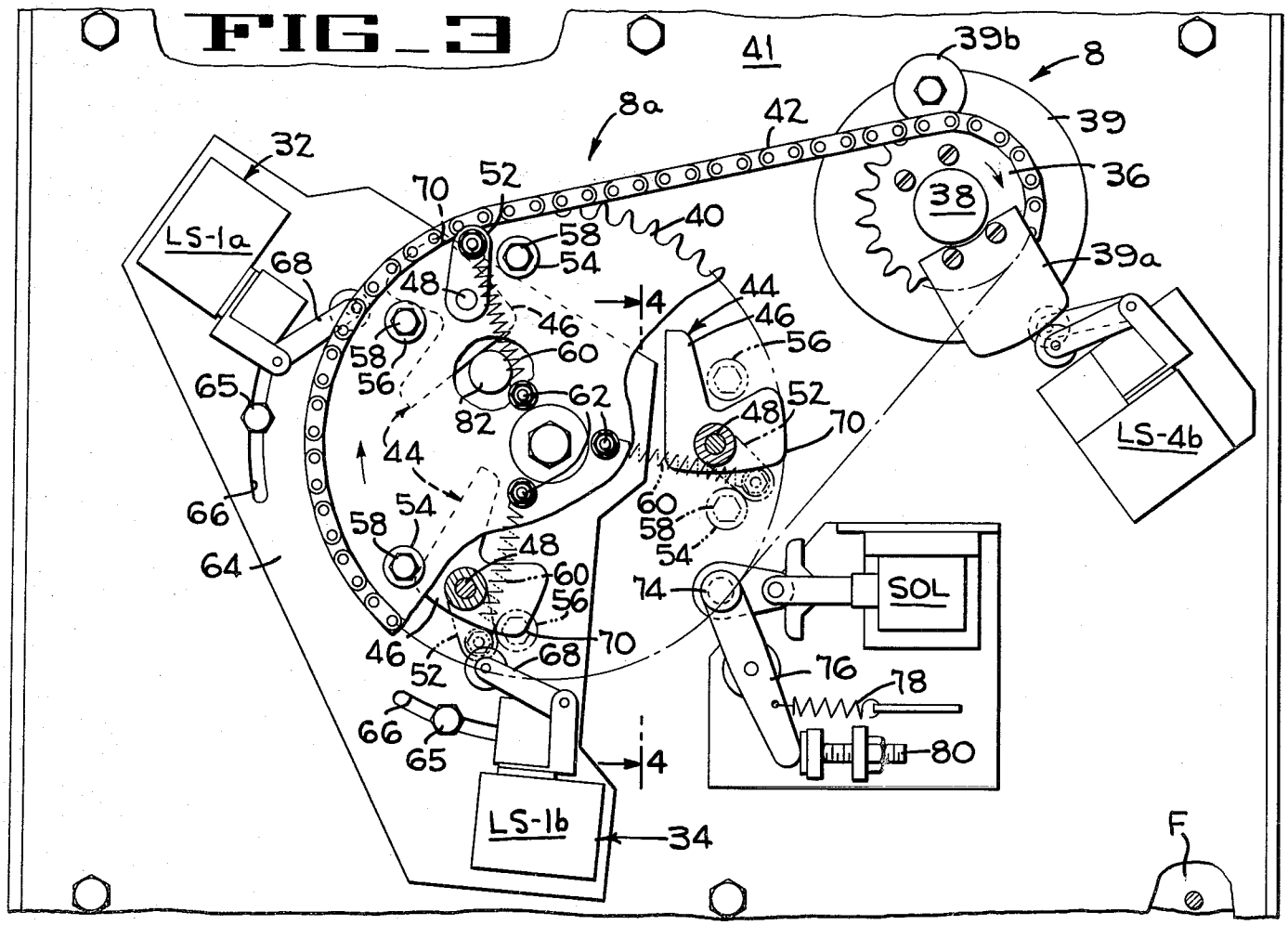
FIG. 3 is an elevation with parts cut away illustrating the mechanical memory system of the no carton—no fill mechanism.

The no pouch—no fill mechanism 8 and its memory system 8*a* (FIGS. 3, 4 and 7) of the present invention is preferably used with a well known turret type pouch opening, filling, purging and sealing machine 9 as diagrammatically illustrated in FIGS. 1 and 2.

In general, the machine 9 preferably includes a feed station FS where flat pouches P are removed from a magazine and are supported by one of several pouch supporting mechanisms 10 (FIG. 5) by a pair of grippers 11. The pouch supporting mechanisms 10 are mounted on an intermittently driven turret 12 that advances each pouch P to a pouch opening station OS. During advancement into the station OS the pouch is held closed by a stationary cam 13 (FIG. 5) which bears against a roller 14 loosely connected to a pair of gripper arms 15 pivoted about pins 16. When dwelling at the opening station, the roller 14 moves along the stationary cam 13 and onto an oscillating cam 17 actuated by the pouch advancing machine 9 and moving in the direction of arrow A allowing a spring 18 to permit the grippers to move toward each other as a pair of suction cups 19 grip the sides of the pouch adjacent the open upper edges thereof, thereby opening the upper end of the pouch as illustrated in FIG. 5. While at the pouch opening station OS, the opening operation may be assisted by directing a jet of steam or air into the pouch. While the pouch P is at the opening station, the no pouch—no fill mechanism 8 and its memory system 8*a* detects whether or not a pouch is present and is properly opened. This mechanism 8 and its memory system 8*a* will be described in detail hereinafter.

The open pouch is then indexed into a first filling station FS-1 and thereafter into a second filling station FS-2 where one or two types of products are discharged into the pouch. For example, the products may be meat and a sauce with the upper surface of the product being substantially at the level indicated in FIG. 1, and with a pouch headspace 20 being defined above the product level.

After the pouch has been filled, it is advanced to the air purging station PS where air is purged from the head space and/or from within the product if a particulate product is being packaged. While at the purging station, the upper end of the pouch is closed by moving the grippers 11 away from each other in a manner well known in the art. The air purging apparatus 22 and its method of operation are described in my copending patent application Ser. No. 110,652 filed on Jan. 24, 1980 for Method and Apparatus For Purging Air From Containers.

The filled, purged, and closed pouch is then advanced to a first sealing station SS-1 and thereafter to a second sealing station SS-2 where the upper end of the pouch is heat sealed by the clamping action of electrically heated sealing bars at each sealing station. The sealed pouch P is then indexed into a discharge station DS where the seals may be cooled, if necessary, by applying pressure thereto with a pair of cooling bars; and thereafter the pouch is released from the grippers upon a take-away conveyor for removal of the hermetically sealed pouch from the machine.

The illustrated machine 12 is an intermittently driven, 30 pouch per minute machine with the cycle time of the machine being 2 seconds per cycle with two thirds of a second being used to index the pouch P from station to station.

All of the above operations, except the specific purging operation disclosed in my above-mentioned application, and the no pouch—no fill mechanism 8 with its memory system 8*a* of the present invention, are well known in the art and are set forth herein merely to define in general terms the operations necessary to package food or other types of products in hermetically sealed pouches P. If a more detailed description is desired for a fuller understanding of the several components (not illustrated) at the several stations, reference may be had to assignee's Wilson et al U.S. Pat. No. 4,016,705 which issued in the United States on Apr. 12, 1977 and which describes the components in an inline, rather than a turret type machine. The disclosure of the Wilson patent is incorporated by reference herein.

In general, the no pouch—no fill mechanism 8 (FIGS. 3, 4 and 7) includes the combination of the vacuum detection system 26 (FIG. 7) coupled with the mechanical memory system 8*a* to control the actuation (or non-actuation) of two filling valve systems 28, 30 (only diagrammatically shown in FIGS. 1 and 2) through filling valve system circuits 32 and 34, respectively, which are initiated by closing switches LS-1*a* and LS-1*b*, respectively.

The mechanical memory system 8*a* (FIGS. 3, 4 and 7) comprises a drive sprocket 36 that is keyed to a shaft 38 that receives its power from the pouch machine 9 and is driven one revolution per indexing cycle of the pouch machine 9. The shaft 38 also has a master cam 39 secured thereto with two space lobes 39*a* and 39*b* thereon to actuate switches of the vacuum detection system 26. The drive sprocket 36 is connected to a sprocket carrier 40 by a drive chain 42 and is journalled on a vertical sub-frame or plate 41 secured to the main frame F of the pouch machine 9. The carrier 40 is driven one-third revolution per cycle and has three equally spaced mechanical memory units 44 thereon.

Each memory unit 44 comprises L-shaped switch actuating finger 46 secured to a stub shaft 48 that is journalled in a sleeve 50 secured to a carrier 40. An overcenter stop lever 52 is secured to the other end of the shaft 48 and is adapted to be pivoted between stop rollers 54 and 56 secured to the carrier 40 by shouldered cap screws 58 or the like. A tension spring 60 is connected between the free end of the stop lever 52 and to an anchor bolt 62 which is secured to the carrier 40 near its axis of rotation. Thus, when the axis of the spring 60 is on one side of the stub shaft 48, it will resiliently hold the stop lever 52 against the stop 56 until external forces are applied causing the axis of the spring 60 to pivot to the other side of the shaft 48 at which time the lever will bear against the stop roller 54.

As shown in FIG. 3, two normally open switches LS-1*a* and LS-1*b* of the filling valve systems 28 and 30, respectively, when closed by the associated memory unit 44 initiate the metering or discharge of the product contained in the associated filler system into a pouch therebelow.

The switches LS-1*a* and LS-1*b* are secured to a generally triangular plate 64 which is secured to the vertical plate 41 by cap screws 65 screwed into the plate 41 and extending through arcuate slots 66 in the switch plate 64. Thus, both switches may be adjusted arcuately about the axis of rotation of the carrier 40 to accurately position the switches relative to the mechanical memory units for timing purposes. It will be noted that rollers on the ends of the switch actuating elements 68 of the switches lie in the same plane and within the path of movement of the caming surfaces 70 of the switch actuating fingers 46 when the three memory units 44 are positioned against the forward stops 54. When against the forward stops, the memory units 44 are in their switch actuating positions as indicated by the right hand memory unit 44 in FIG. 3.

When the memory units 44 are in their inactive, no pouch positions and are retracted against stop 56 as indicated by the lowermost unit 44 in FIG. 3, the camming surfaces 70 of the fingers 46 do not contact the switch element 68. Thus, the switches LS-1*a* and LS-1*b* will not close and therefore no product will be released from either of the filling valve systems 28 and 30 under these conditions.

If a pouch is not present (or is not properly opened) at the pouch opening station, a signal will be sent by vacuum detection system 26 to a solenoid SOL for deenergizing the solenoid causing a trip roller 74 connected thereto and journalled on one end of an arm 76 to enter the path of movement of the next adjacent approaching finger 46. The arm 76 is journalled on the plate 41 and has a spring 78 connected between its other end portion and the plate 41 for normally urging the roller 74 into the path of movement of the finger. The free end of the arm engages an adjustable stop 80 when in its illustrated no pouch position.

When in the no pouch position, the roller 74 will contact the switch actuating finger 46 of the associated memory unit 44 causing the finger to pivot from its normally active position as indicated by the right hand unit 44 in FIG. 3 to its inactive position as indicated in the lower unit 44 in FIG. 3. After the inactive finger 46 sequentially moves past both switches LS-1*a* and LS-1*b* without closing the switches, it is reset in its active position by contacting a reset pin 82 secured to a switch plate 64. The upper left hand memory unit 44 in FIG. 3 is illustrated in the process of being preset into its active position by the reset stop pin 82.

When a properly opened pouch is detected at the opening station OS, a signal is sent to the solenoid SOL by the vacuum detection system 26 which energizes the solenoid and draws the roller 74 out of the path of movement of the next approaching memory unit 44. That memory unit 44 then sequentially closes switches LS-1*a* and LS-1*b* to meter products from the filling system into the detected and properly opened pouch at both filling stations FS-1 and FS-2.

The vacuum detection system 26 (FIG. 7) is provided to detect the presence of a properly opened pouch at the opening station thus energizing solenoid SOL and withdrawing the roller 74 from the path of movement of the next approaching memory unit; or to detect the absence of a pouch or the presence of an improperly opened pouch thus de-energizing the solenoid SOL and projecting the roller 74 into the path of movement of the L-shaped fingers 46 thereby moving the next adjacent finger 46 to its inactive position so that the switches LS-1*a* and LS-1*b* will not be closed and no product will be discharged or metered into a station where no pouch is properly opened to receive the product.

If both suction cups 19 are clamped against the associated walls of a pouch when they have moved outwardly to their pouch opening position, a high vacuum is applied from conduit 84 to the vacuum switch 86 thereby closing normally open switch LS-8. Prior to the suction cups reaching their pouch pickup position, the lobe 39*a* on the one revolution per cycle master cam 39 momentarily opens the main reset switch LS-4*b* for de-energizing relay CR and solenoid SOL, and then returns to its normally closed position as illustrated. As the suction cups 19 approach their final opening position, the second cam lobe 39*b* closes switch LS-7. With both switches LS-8 and LS-7 closed, relay CR is energized closing relay contact 1CR and thus energizing solenoid SOL through reset contact LS-4*b* and closed relay contact 1CR. Energization of solenoid SOL pulls trip roller 74 out of the path of movement out of the L-shaped switch actuating finger 46 thereby causing the two filling systems to meter food products into the associated pouch when dwelling at filling stations FS-1 and FS-2, respectively.

If a pouch is not present at the pouch opening station OS, or if the two walls of the pouch do not open but instead stick together so that the unopened pouch is gripped only by one of the suction cups 19 at the pouch opening station OS, air will be drawn through the open suction cup. Under these conditions insufficient vacuum will be present at the vacuum switch 86 to cause normally open switch LS-8 to close. Thus, the solenoid SOL will remain de-energized causing the trip roller 74 to engage and pivot the associated L-shaped switch actuating finger 46 to its inactive position as illustrated by the lower unit 44 in FIG. 3. That particular finger 46 will be intermittently indexed past both filling stations FS-1 and FS-2 without contacting switches LS-1*a* and LS-1*b* and thus will not discharge any of the product from the two filling valves at that time. Thereafter, the inactive fingers 46 will contact the reset stop pin 82 which returns the finger to its extended, active position.

In the event it is desired to operate the filling valve system 28,30 (FIG. 1) without pouches being present for cleaning the system or the like, a normally open toggle switch TS is provided to by-pass the above described vacuum detection system. When no pouch—no fill override switch TS is closed, solenoid SOL will be energized regardless of the presence or absence of pouches.

From the foregoing description it will be apparent that the no pouch—no fill mechanism of the present invention includes the combination of a vacuum detection system and a mechanical memory system which will prevent two filling valve systems at different stations from discharging products if a pouch is improperly opened or is not present to receive the product. It is also apparent that a unique and simple mechanical memory system is provided and is suitable for use in the filling art as well as in other article handling arts as a sub-combination.

Although the best mode contemplated for carrying out the present invention has been herein shown and described, it will be apparent that modification and variation may be made without departing from what is regarded to be the subject matter of the invention.

I claim:

1. In a pouch opening and filling machine having two filling valves, the combination of a no pouch—no fill mechanism and memory system: the combination comprising pouch supporting means for cyclically moving a pouch from a pouch opening station sequentially into two spaced filling stations in positions to first receive a product from one filling valve and to thereafter receive a product from another filling valve; means for gripping and opening pouches when at said opening station; pouch detecting means associated with said gripping means for detecting the presence of a properly opened pouch, and for detecting the absence of a pouch or the presence of an improperly opened pouch; and memory means responsive to said pouch detecting means for sequentially preventing opening of said two filling valves when said pouch supporting means is in said two filling stations and no pouch is present or an improperly opened pouch is in said filling stations.

2. An apparatus according to claim 1 wherein said machine is an intermittently driven machine.

3. An apparatus according to claim 1 wherein said machine is an intermittently driven rotary machine.

4. In a pouch opening and filling machine having two filling valves, the combination of a no pouch—no fill mechanism and memory system: the combination comprising pouch supporting means for cyclically moving a pouch from a pouch opening station sequentially into spaced filling stations in positions to receive a product from both filling valves; means for gripping and opening pouches when at said opening station; pouch detecting means associated with said gripping means for detecting the presence of a properly opened pouch, and for detecting the absence of a pouch or the presence of an improperly opened pouch; and memory means responsive to said detecting means for preventing opening of said two filling valves when said pouch supporting means is in said two filling stations and no pouch is present or an improperly opened pouch is in said filling station: said memory system comprising abutment means movable between a first position in response to detecting a properly opened pouch and a second position in response to detecting the absence of a pouch or an improperly opened pouch; a first switch operatively connected to one of said filling valves; a second switch spaced from said first switch and operatively connected to a second filling valve; said filling valves being opened in response to said associated switches being actuated; a movable carrier driven in timed relation with said cyclically movable pouch supporting means; at least one switch actuating finger mounted on said carrier for movement relative to said carrier between two positions and for movement with said carrier in a first path when in said first position and in a second path when in said second position, said finger when moving along said first path being effective to sequentially actuate said switches thereby opening said valves and discharging products into the pouch; said abutment means being held out of said first path in response to said detecting means detecting a properly opened pouch, and being moved into said first path in response to detecting the absence of a pouch or the presence of an improperly opened pouch, said finger being moved out of said first path and into the second path in response to engaging said abutment means, and means for resetting said finger into said first path once per cycle of operation when moving between said second switch and said abutment means.

5. An apparatus according to claim 4 wherein said machine is an intermittently driven machine.

6. An apparatus according to claim 4 wherein said machine is a rotary machine that is intermittently driven.

7. An apparatus according to claim 4 wherein said movable carrier is a rotary carrier and wherein said first path is a circular path.

8. An apparatus according to claim 7 wherein a plurality of fingers are mounted at equally spaced intervals on said carrier and wherein said rotary carrier is driven at a fraction of the rate per cycle equal to the one divided by number of fingers mounted on said rotary carrier.

9. An apparatus according to claim 8 wherein three fingers are mounted on said rotary carrier and said carrier is driven one-third revolutions per each cycle of the machine.

10. An apparatus according to claim 4 wherein said finger is mounted on said carrier for pivotal movement about an axis, and additionally comprising a pair of arcuately spaced finger stops on said carrier, resilient means connected between said finger and said carrier and positioned on one side of said axis when said finger is in said first path and on the other side of said axis when said finger is in said second path for releasably retaining said finger in adjusted position until said finger engages and moves past said resetting means or said abutment means which shift the finger to its other position.

11. An apparatus according to claim 4 wherein said gripping means comprises a pair of suction cups movable toward and away from opposite side walls of a pouch to first engage said side walls and then move outwardly away from each other, and means for applying vacuum to said cups upon initial engagement with the pouch walls and until the cup has moved outwardly to their pouch opening positions; said detecting means including a vacuum switch that is responsive upon detecting a high vacuum before said suction cups reach their full open position to transmit a signal to said memory means which initiates opening of said filling valves when the open pouch is in position to receive the product from the two valves.

12. A mechanical memory system associated with conveying means for moving an article past an article detecting station and past article handling systems at first and second stations, which handling systems are capable of performing functions at said stations, comprising: a cyclically movable carrier driven in timed relation with the movement of the article; a plurality of equally spaced memory units pivoted on said carrier with each unit movable between an active position for sequentially activating said article handling systems in response to detecting a properly positioned article in said detecting station when the article has subsequently moved into said first and second stations, and an inactive position for preventing actuation of said article handling system in response to detecting an improperly positioned article or the absence of an article in said detecting station when no article or improperly positioned article has subsequently moved into said first and second stations; trip means in the path of movement of said memory units for pivoting each unit to said active position once per cycle of said carrier, and means forpivoting said memory units into said inactive position in response to detecting an improperly positioned article or the absence of an article at said detecting station.

13. An apparatus according to claim 12 wherein said cyclically movable carrier is a rotary carrier.

14. A memory system according to claim 12 or 13 wherein said articles are containers and said article handling systems are filling valves for discharging products into the containers.

15. A mechanical memory system for use with an article carrying conveyor having spaced function performing stations at which functions are to be performed only if operational signals are sent to the stations indicating that an article is properly positioned at a remote upstream station, said mechanical memory system comprising: a rotary carrier driven in timed relation with said conveyor; a plurality of memory units pivotally mounted on said carrier at equally spaced intervals; a pair of radially spaced switch means disposed adjacent said carrier; a switch actuating finger on each memory unit, each finger being movable into active position for sequentially engaging and actuating said switch means for sending operational signals to said spaced stations, and an inactive position moving along a path spaced from said switch means; resetting means for engaging and moving each inactive finger to its active position once per revolution of said carrier; and finger shifting means disposed between said resetting means and said switch means responsive to the absence of a properly positioned article in said article detecting station for shifting the associated finger into said inactive position thereby precluding actuation of both of said switch means when no article or an improperly positioned article is at said function performing stations.

16. An apparatus according to claim 15 wherein said article is a container and wherein filling valves are provided at said operational stations for directing products into containers when said signals are received.

17. A mechanical memory system associated with conveying means for moving an article past an article detecting station and past article handling systems at first and second stations, comprising: a cyclically movable carrier driven in timed relation with the movement of the article; a plurality of equally spaced memory units on said carrier with each unit movable between an active position for sequentially activating said article handling systems and an inactive position for preventing actuation of said article handling system; trip means in the path of movement of said memory unit for moving each unit to said active position once per cycle of said carrier, detecting means for detecting the absence of an article or the presence of an improperly positioned article at said detecting station, and means for moving said memory units into said inactive position in response to detecting the absence of an article or the detection of an improperly positioned article.

* * * * *